US007370951B2

(12) United States Patent
Huliba

(10) Patent No.: US 7,370,951 B2
(45) Date of Patent: May 13, 2008

(54) METHOD FOR ESTABLISHING JETS FOR AN INK JET PRINTHEAD

(75) Inventor: David A. Huliba, Centerville, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/673,695

(22) Filed: Feb. 12, 2007

(65) Prior Publication Data

US 2007/0126829 A1 Jun. 7, 2007

Related U.S. Application Data

(62) Division of application No. 10/839,466, filed on May 5, 2004, now Pat. No. 7,207,665.

(51) Int. Cl.
*B41J 2/18* (2006.01)

(52) U.S. Cl. ..... 347/89

(58) Field of Classification Search ..... 347/89, 347/85, 84, 90, 75, 69, 68
See application file for complete search history.

(56) References Cited

U.S. PATENT DOCUMENTS 4,314,254 A 2/1982 Bok et al.
5,408,738 A 4/1995 Schantz et al.
5,682,191 A 10/1997 Barrett et al.
6,299,271 B1 10/2001 Imai
6,722,752 B2 4/2004 Davis et al.
2001/0017642 A1 8/2001 Shigemura
2005/0057627 A1* 3/2005 De Marco et al. ..... 347/89

* cited by examiner

*Primary Examiner*—K. Feggins

(57) ABSTRACT

The method and equipment for detangling individual jets in an ink jet print station utilizes a reservoir containing fluid and a printhead. The printhead has a drop generator, an orifice structure connected to the drop generator for forming numerous jets, a catcher connected to the drop generator; and a charge device secured to the catcher. A fluid supply system is connected between the printhead and the reservoir. A controller and numerous actuators are connected to the drop generator, and adapted to vibrate the drop generator. A fluid pump is connected to the fluid supply line, is operated by the controller, and is adapted to raise the pressure on the drop generator to at least an operating pressure and lower the pressure on the drop generator to a minimal pressure to prevent entanglement of the jets.

6 Claims, 3 Drawing Sheets

METHOD FOR ESTABLISHING JETS FOR AN INK JET PRINTHEAD

CROSS REFERENCE TO RELATED APPLICATIONS

This is a divisional of application Ser. No. 10/839,466 filed May 5, 2004 now U.S. Pat. No. 7,207,665.

FIELD OF THE INVENTION

The present embodiments relate to a continuous ink jet print station for detangled jets, in particular, to a method for establishing detangled jets in an ink jet printer.

BACKGROUND OF THE INVENTION

The present methods and devices relate to multi-jet generator devices useful in ink jet printers, such as those used as output devices for computers and the like, for printing, marking or plotting on various surfaces.

Droplets are formed in an ink jet print station by forcing a printing fluid, or ink, through a nozzle. Hence, the ink-jet devices typically include a multitude of very small diameter nozzles or orifices.

A need exists for an ink jet system and method that establishes jets for ink jet printing that are able to operate with a wide variety of ink compositions without decreasing the reliability of the system and without having tangled jets.

The embodied methods described herein are designed to meet these needs.

SUMMARY OF THE INVENTION

The method and equipment for detangling individual jets in an ink jet print station utilizes a reservoir containing fluid and a printhead. The printhead has drop generator, orifice structure connected to the drop generator for forming numerous jets, a catcher connected to the drop generator; and charge device secured to the catcher. A fluid supply system is connected between the printhead and the reservoir. A controller and numerous actuators are connected to the drop generator and adapted to vibrate the drop generator. A fluid pump is connected to the fluid supply line is operated by the controller and is adapted to raise the pressure on the drop generator to at least an operating pressure and lower the pressure on the drop generator to a minimal pressure to prevent entanglement of the jets.

BRIEF DESCRIPTION OF THE DRAWINGS

In the detailed description of the preferred embodiments presented below, reference is made to the accompanying drawings, in which.

The present embodiments are detailed below with reference to the listed Figures.

DETAILED DESCRIPTION OF THE INVENTION

Before explaining the present embodiments in detail, it is to be understood that the embodiments are not limited to the particular descriptions and that it can be practiced or carried out in various ways.

The embodied methods and systems were devised because ink jet printers with small orifice printheads produce jets that become tangled. Tangled jets cause the jets to short the charge device of the typical ink jet printhead. Shorted charge devices cause printhead errors and even a printhead shutdown. The embodied methods and systems were devised to prevent shorts in the charge device, typically the charge plate, by establishing detangled jets of a jet array of an orifice structure.

The present methods and systems are for high resolution printheads with many small diameter orifices that create high quality images.

The methods and systems permit a printhead operation with higher concentrations of ink that generally provide an improved quality of image.

The embodied methods and systems extend the operating range of small diameter orifice printheads to allow for fluids with higher viscosity than known in the current art. The ability to allow higher viscosity fluids to operate through the printhead enables greater versatility of the printhead and more advanced applications. In addition, the methods and systems permit even smaller holes to be used successfully on an orifice structure to result in even higher quality process images with more grey levels than other types of printheads with larger orifices.

The embodied methods and systems reduce labor time, avoid the need for operator intervention, and enable the systems to be more user friendly by permitting the use of a common state table for different viscosity inks.

Figure 1:
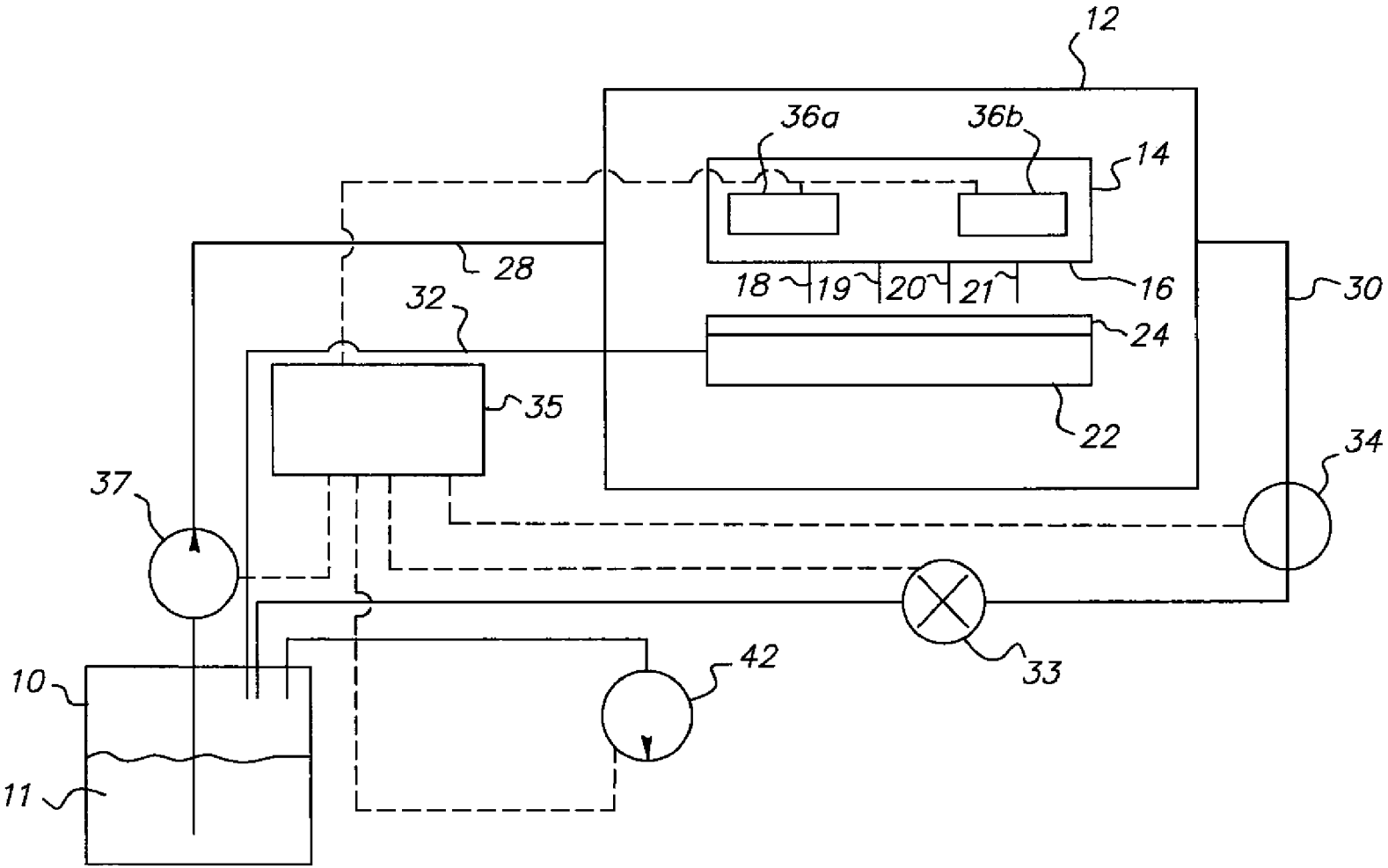
FIG. 1 depicts a schematic of the fluid system of the print station.

With reference to the figures, FIG. 1 depicts a schematic of the improved print station used with the embodied methods.

The print station includes a reservoir 10 for holding fluid 11, such as ink jet ink. The reservoir is adapted to contain between 0.1 liters and 6 liters of fluid. The fluid can be a cleaning fluid, a dye based ink, a pigment based ink, a water based ink, an oil based ink, or a solvent based ink or combinations of these inks and fluids. Water-based inks, such as a FD 1007 black ink, are readily available from Kodak Versamark of Dayton, Ohio.

The printhead 12 includes a drop generator 14 and an orifice structure 16 connected to the drop generator. The orifice structure has numerous orifices for forming numerous jets 18, 19, 20, and 21. Although FIG. 1 depicts only four jets, many more are typically used. For example, the orifice structure 16 can include more than 240 jets per inch.

Figure 2:
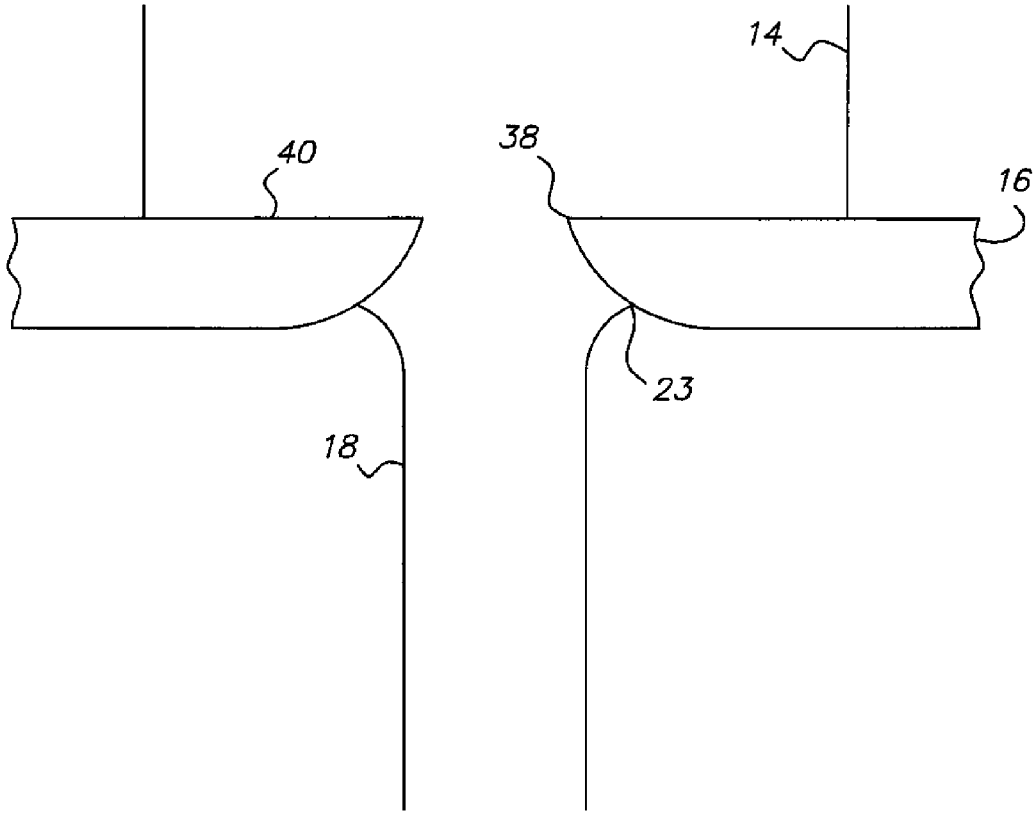
FIG. 2 depicts a detailed cross section of the orifice place used in the ink jet print station.

The orifice structure 16 can have orifices that have a diameter ranging between 1 mil and 0.4 mils with a preferred range of less than 1 mil. Alternative embodiments have diameters between 0.7 mils and 0.4 mils, preferably less than 0.58 mils. Each orifice structure can include an electroformed orifice structure with one or more sharp edges 38, as depicted in more detail in FIG. 2. The sharp edges 38 are located on the drop generator side 40 of the orifice structure. FIG. 2 depicts the meniscus 23 of the jet 18.

Returning to FIG. 1, the printhead 12 includes a catcher 22 disposed in a spaced apart relationship from the drop generator 14. A charge device 24 is secured to the catcher for extending a charge to some of the droplets emanating from the jets 18, 19, 20, and 21.

The fluid supply system includes a fluid supply line 28 connected between the drop generator 14 and the reservoir 10. A return line 30 connects to the drop generator 14 and the reservoir 10. A catcher return line 32 is connected between the catcher 22 and the reservoir 10. The fluid supply line, the catcher return line and the return line may all be a flexible line adapted to support pressures ranging between 10 psi and 200 psi without clogging or exploding. The return line and catcher return lines typically have outer diameters of about 0.375 inches.

A controllable valve 33 is located in the return line 30. The controllable valve 33 is adapted to open and close the return line. Examples of usable controllable valves 33 include two-way controllable valves that can be electrically controlled or otherwise controlled. A solenoid valves is a preferred controllable valve. A pressure transducer 34 is located in the return line 30 between the drop generator 14 and the controllable valve 33.

The printhead 12 has a controller 35 that operates the controllable valve 33 in the fluid supply system. The controller 35 can be an electronic controller with a central processing unit (CPU). The electronic controller is adapted to control a fluid pump 37, which can be an ink pump, any of the listed plurality of valves, or a vacuum pump 42 in the print station. The vacuum pump is connected to the reservoir enabling the reservoir to provide a reduced pressure to the catcher return line and the return line.

Numerous actuators 36*a* and 36*b*, which can be piezoelectric actuators, are connected to the drop generator 14 and the controller 35. The actuators 36*a* and 36*b* are adapted to vibrate the drop generator that in turn vibrates the orifice structure. In a preferred embodiment, the actuators 36*a* and 36*b* vibrate the drop generator at a rate between 50 kHz and 200 kHz.

A fluid pump 37 connects to the fluid supply line and is operated by the controller 35. The fluid pump 37 is adapted to raise the pressure on the drop generator 14 to at least an operating pressure of the printhead and to lower the pressure on the drop generator to a minimal pressure thereby preventing entanglement of the jets.

In an alternative embodiment, the pump 37 variably pumps the fluid at a pressure to collapse and expand, cyclically expanding and contracting the meniscus 23 of the jets projecting from the orifices, to maintain free flowing detangled jets.

In another embodiment, the pressure on the printhead, more specifically the drop generator, is cycled between one and ten times, more preferably between three and eight times using an abrupt, non-gradual change in pressure to prevent jet tangling. Each cycle alternates between an operating pressure and a pressure lower than the operating pressure. The multiple cycling of the pressure ensures the jets maintain a free flowing and de-tangled orientation.

Vacuum pump 42 is connected to the reservoir. By including a vacuum pump 42, the reservoir is able to provide a reduced pressure to the catcher return line and the return line.

Figure 3:
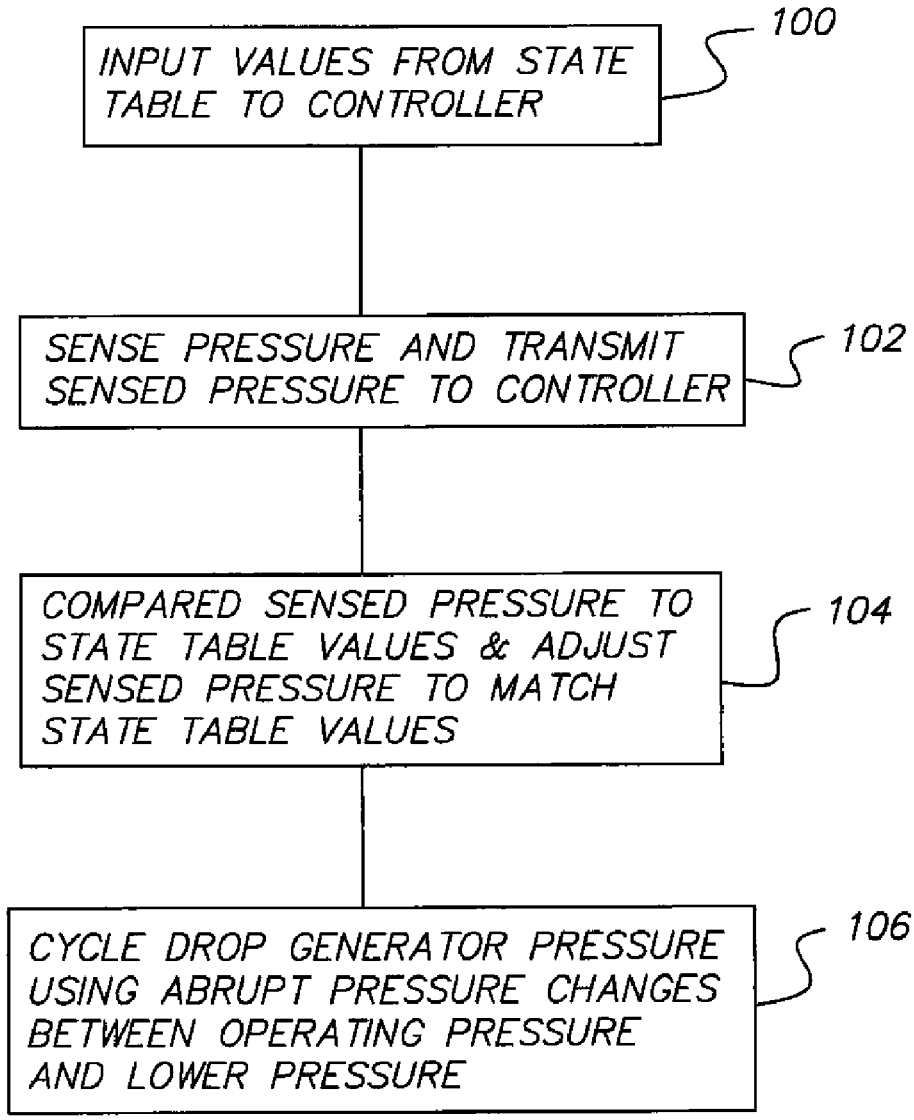
FIG. 3 depicts a block diagram of the method.

FIG. 3 depicts a block diagram of a method for establishing detangled jets in an ink jet print station.

The first embodiment of the method begins by inputting values from a state table to a controller for a print station (Step 100). The values input from the state table include at least two states, the operating pressure for the drop generator and a pressure lower than the operating pressure. The print station is depicted in FIG. 1.

The next step involves sensing a pressure at the drop generator and transmitting the sensed pressure to the controller (Step 102).

Next, the sensed pressure is compared to the values input from the state table (Step 104) and if the sensed pressure is different from the input value of the state table, a signal is transmitted to the fluid pump to adjust the pressure of the fluid supply line to meet the value from the state table.

Finally, the controller cycles the drop generator pressure using abrupt, non gradual changes in pressure, wherein each cycle alternates between an operating pressure and a pressure lower than the operating pressure of the printhead to insure the jets maintain a free flowing, detangled orientation, as defined by the sequence of states in the state table.

This cycling can be between one and ten cycles. A preferred example has the pressure of the drop generator cycling six cycles between 20 psi and 35 psi per cycle.

Table 1 depicts a representation of a state table from which values can be input to a controller according to the method.

TABLE 1

| Pressure at transducer, 34 Psi | Vacuum at reservoir, 10 in Hg | Stimulation % of full output | Controllable Valve, 33 | Time Sec |
|---|---|---|---|---|
| 2 | 12 | 30 | Open | 10 |
| 20 | 12 | 30 | Close | 6 |
| 20 | 12 | Superstim | Close | 10 |
| 35 | 12 | 0 | Close | 10 |
| 20 | 12 | Superstim | Close | 10 |
| 35 | 12 | Superstim | Close | 10 |
| 20 | 12 | 0 | Close | 10 |
| 35 | 12 | 0 | Close | 5 |

As an example, the cycling of the pressure at the drop generator fluid supply line at the orifice structure with 2700 jets at 300 jets per inch, using three abrupt changes from the low pressure described above to at least the operating pressure, generally between 20 psi to 35 psi per cycle. A "cycle" is viewed as the change from the high pressure to the low pressure and then back to the high pressure again.

Utilizing the methods, a wider range of ink concentrations can be used consistently to yield a high quality image.

The embodied method enables production of images with high resolutions of at least 300 dpi with between one grey level and five grey levels.

The method includes vibrating the drop generator with actuators at a frequency ranging between 50 kHz and 200 kHz.

In an alternative embodiment, the method can further include using the vacuum pump or another device to form a negative pressure on the reservoir to return ink from the printhead to the reservoir through the catcher return line and the return line with less energy usage.

The embodiments have been described in detail with particular reference to certain preferred embodiments thereof, but it will be understood that variations and modifications can be effected within the scope of the embodiments, especially to those skilled in the art.

PARTS LIST

| | |
|---|---|
| 10. | reservoir |
| 11. | fluid |
| 12. | printhead |
| 14. | drop generator |
| 16. | orifice structure |
| 18. | jet |
| 19. | jet |
| 20. | jet |
| 21. | jet |
| 22. | catcher |
| 23. | meniscus |
| 24. | charge device |
| 28. | fluid supply line |
| 30. | return line |
| 32. | catcher return line |
| 33. | controllable valve |
| 34 | pressure transducer |
| 35. | controller |
| 36a. | piezoelectric actuator |
| 36b. | piezoelectric actuator |
| 37. | fluid pump |
| 38. | sharp edge |
| 40. | drop generator entrance side |
| 42. | vacuum pump |
| 100. | step - inputting values from a state table to a controller for a print station |
| 101. | step - sensing a pressure at the printhead and to transmit the sensed pressure to the controller |
| 103. | step - comparing sensed pressure to the values input from the state table |
| 104. | step - transmitting a signal to the pump to adjust the pressure of the fluid supply line to meet the value from the state table |
| 106. | step - cycling the pressure of the fluid supply line between three and eight cycles using an abrupt, non-gradual change in pressure |

What is claimed is:

1. A method for establishing detangled jets in an ink jet print station, wherein the method comprises the steps of:

a. inputting values from a state table to a controller for a print station, wherein the print station comprises:
   i. a reservoir containing fluid;
   ii. a printhead comprising:
      1. a drop generator;
      2. an orifice structure connected to the drop generator forming a plurality of jets;
      3. a catcher connected to the drop generator;
      4. a plurality of actuators connected to the drop generator adapted to vibrate the drop generator; and
   iii. a fluid supply line connected between the printhead and the reservoir;
   iv. a return line connected the printhead and the reservoir;
   v. a catcher return line connected between the catcher and the reservoir;
   vi. a controllable valve disposed in the return line adapted to open and close the return line;
   vii. a pressure transducer disposed in the return line between the drop generator and the controllable valve;
   viii. a controller for operating the controllable valve and the actuators;
   ix. a fluid pump connected to the fluid supply line and the controller; and
b. sensing pressure with the pressure transducer and transmitting the sensed pressure to the controller;
c. comparing the sensed pressure to the values from the state table;
d. if the pressure is different from the value of the state table, transmitting a signal to the fluid pump to adjust the pressure of the fluid supply line to meet the value from the state table; and
e. cycling the pressure of the drop generator using an abrupt, non-gradual change in pressure, wherein each cycle alternates between an operating pressure and a pressure lower than the operating pressure to insure the jets maintain a free flowing and detangled orientation.

2. The method of claim 1, wherein the step of cycling of the pressure of at the drop generator is performed between one and ten cycles.

3. The method of claim 1, wherein the step of cycling the pressure of the drop generator is six cycles and the operating pressure and the pressure lower than the operating pressure alternates between 20 psi to 35 psi per cycle.

4. The method of claim 1, wherein the printhead produces an image with a high resolution of at least 300 dpi with between one grey level and five grey levels.

5. The method of claim 1, further comprising the step of vibrating the drop generator with actuators at a frequency ranging between 50 kHz and 100 kHz.

6. The method of claim 1, further comprising the step of forming a negative pressure on the reservoir to return fluid from the printhead to the reservoir through the catcher return line and the return line.

* * * * *